US011846136B2

(12) United States Patent
Lanzafame

(10) Patent No.: US 11,846,136 B2
(45) **Date of Patent: *Dec. 19, 2023**

(54) LADDER EXTENSION BRAKE

(71) Applicant: Philip F. Lanzafame, Poulsbo, WA (US)

(72) Inventor: Philip F. Lanzafame, Poulsbo, WA (US)

(73) Assignee: Philip F. Lanzafame, Poulsbo, WA (US)

( * ) Notice: Subject to any disclaimer, the term of this patent is extended or adjusted under 35 U.S.C. 154(b) by 635 days.

This patent is subject to a terminal disclaimer.

(21) Appl. No.: 16/797,268

(22) Filed: Feb. 21, 2020

(65) Prior Publication Data

US 2020/0190904 A1 Jun. 18, 2020

Related U.S. Application Data

(63) Continuation of application No. 15/795,958, filed on Oct. 27, 2017, now Pat. No. 10,605,003, which is a continuation-in-part of application No. 14/979,480, filed on Dec. 27, 2015, now abandoned.

(60) Provisional application No. 62/179,951, filed on May 26, 2015, provisional application No. 62/118,622, filed on Feb. 20, 2015.

(51) Int. Cl.

| | |
|---|---|
| ***E06C 7/04*** | (2006.01) |
| ***E06C 1/12*** | (2006.01) |
| ***E06C 5/32*** | (2006.01) |
| ***E06C 5/36*** | (2006.01) |

(52) U.S. Cl.
CPC ..... *E06C 7/04* (2013.01); *E06C 1/12* (2013.01); *E06C 5/32* (2013.01); *E06C 5/36* (2013.01)

(58) Field of Classification Search
CPC ..... E06C 7/04; E06C 7/06; E06C 1/12; E06C 5/32; E06C 5/36
See application file for complete search history.

(56) References Cited

U.S. PATENT DOCUMENTS

| | | | | |
|---|---|---|---|---|
| 369,084 A * | 8/1887 | Smith | ..... | E06C 1/12 182/213 |
| 434,395 A | 9/1890 | Flynn | | |
| 613,848 A * | 11/1898 | Seagrave | ..... | E06C 1/12 182/213 |

(Continued)

FOREIGN PATENT DOCUMENTS

| | | | |
|---|---|---|---|
| DE | 19734333 | 2/1999 | |
| DE | 19734333 A1 * | 2/1999 | ..... E06C 1/12 |

*Primary Examiner* — Marcus Menezes
(74) *Attorney, Agent, or Firm* — TUCKER ELLIS LLP

(57) ABSTRACT

Provided is a braking system for use with an extension ladder having a base section and a fly section movable relative to the base section via an adjustment rope. The braking system includes a bracket for attachment to the fly section. A pulley and an arm are secured to and movable relative to the bracket by the adjustment rope between a first position when no tension is applied to the rope and a second position when tension is applied to the adjustment rope. A cam is movable between an engaged position when the pulley and arm are in the first position with the cam engaging with the base section to prevent movement of the fly section relative to the base section, and a disengaged position when the pulley and arm are in the second position.

18 Claims, 11 Drawing Sheets

(56) References Cited

U.S. PATENT DOCUMENTS 986,517 A * 3/1911 Stevens ..... E06C 7/06 182/210
1,445,848 A * 2/1923 Ridings ..... E06C 1/12 182/210
1,701,123 A * 2/1929 Roberts ..... E06C 1/12 182/213
2,310,441 A * 2/1943 Klum ..... E06C 1/12 182/213
2,975,857 A * 3/1961 Suroff ..... E06C 7/44 182/228.1
3,420,333 A * 1/1969 Atchison ..... E06C 1/12 182/211
3,556,253 A * 1/1971 Kramer ..... E06C 7/06 182/210
3,565,211 A * 2/1971 Blanc ..... E06C 7/06 182/211
3,768,594 A * 10/1973 Kramer ..... E06C 7/06 182/210
3,902,569 A * 9/1975 Bair ..... E06C 1/12 182/211
3,948,353 A * 4/1976 Lane ..... E06C 7/48 182/206
4,364,451 A * 12/1982 Wright ..... E06C 7/06 182/213
4,605,100 A * 8/1986 Inglese ..... E06C 7/06 182/213
4,640,387 A * 2/1987 Bocker ..... E06C 5/12 182/213
5,117,943 A * 6/1992 Schmitt ..... E06C 1/12 182/213
5,924,523 A * 7/1999 Krause ..... E06C 1/12 182/211
6,935,464 B2 * 8/2005 Duan ..... E06C 7/46 182/213
8,348,014 B2 * 1/2013 Kerstetter, Jr. ..... E06C 7/186 182/8
10,605,003 B2 * 3/2020 Lanzafame ..... E06C 7/04

* cited by examiner

LADDER EXTENSION BRAKE

RELATED APPLICATIONS

This application is a continuation of U.S. patent application Ser. No. 15/795,958 filed on Oct. 27, 2017, which is a continuation in part of U.S. patent application Ser. No. 14/979,480 filed on Dec. 27, 2015, which claims priority to and the benefit of U.S. Provisional Application Ser. No. 62/118,622 filed on Feb. 20, 2015 and U.S. Provisional Application Ser. No. 62/179,951 filed on May 26, 2015. The entireties of such applications are incorporated herein by reference.

FIELD OF INVENTION

The present invention relates generally to a braking system for an extension ladder, and more particularly to a braking system that prevents movement of sections of the extension ladder relative to one another when a force is released from a rope of the ladder.

BACKGROUND

Extension ladders have at least one telescoping or fly extension section that slides relative to a base or base section of a ladder to gain additional length or height that is adjusted by pulling on a rope. In many cases, when using the rope, it can slip from the user's hand, thereby releasing the fly or telescoping section accidentally, causing the fly or telescoping extension section to slide uncontrollably downward, potentially causing serious injury to the user's arm, hand, knee or other parts of the body. Additionally, ladder rails will typically slide apart from each other, or unlock at the rung-locks, when the ladder is set down, dropped, moved, bumped, transported, carried or when the base section slides out and away from a structure supporting the top of the ladder.

Locks are known which prevent the two or more sections from sliding relative to each other when the ladder is fully retracted. The locks cannot be engaged at any point in the travel of the sections relative to each other.

SUMMARY OF INVENTION

Disclosed is a braking system for use with an extension ladder having a base section and a fly section movable relative to the base section via an adjustment rope. The braking system includes a bracket for attachment to the fly section. A pulley is movable relative to the bracket by the adjustment rope between a first position when no tension is applied to the adjustment rope and a second position when tension is applied to the adjustment rope. An arm is movable with the pulley between the first and second positions. The braking system further includes a cam attached to the arm and movable between an engaged position when the pulley and arm are in the first position with the cam engaging with the base section to prevent movement of the fly section relative to the base section, and a disengaged position when the pulley and arm are in the second position with the cam disengaging from the base section to allow movement of the fly section relative to the base section. A resilient member can be attached to the arm and attachable to the fly section. The resilient member is configured to bias the arm in the first position and to move the arm from the second position to the first position when no tension is applied to the rope.

In certain embodiments, the bracket includes a slot, and the system further includes a first pin extending through the pulley, the arm, and the slot such that movement of the first pin in the slot effects movement of the pulley and arm between the first and second positions. The arm can include a vertical portion and a horizontal portion. The cam and the resilient member are attached to the horizontal portion, and the first pin extends through the horizontal portion. The cam can be pivotally attached to the vertical portion of the arm by a second pin and the cam can also be pivotally attached to the bracket by a third pin.

In further embodiments, the resilient member is a spring. In still other embodiments, the cam can include a tread that engages with the base section in the engaged position. The tread can be made of rubber.

In other embodiments, the braking system can include a pulley that interacts with a rope. A cam is coupled with the pulley such that the cam is movable between an engaged position when the pulley is in a first position with the cam engaging with the base section to prevent movement of the fly section relative to the base section, and a disengaged position when the pulley is in a second position with the cam disengaging from the base section to allow movement of the fly section relative to the base section. A resilient member is coupled to at least one of the pulley or the cam, the resilient member biasing the cam in the engaged position. In certain embodiments, the resilient member is a spring. In some embodiments, the spring is a torsion spring.

The foregoing and other features of the application are described below with reference to the drawings.

DETAILED DESCRIPTION

Figure 1:
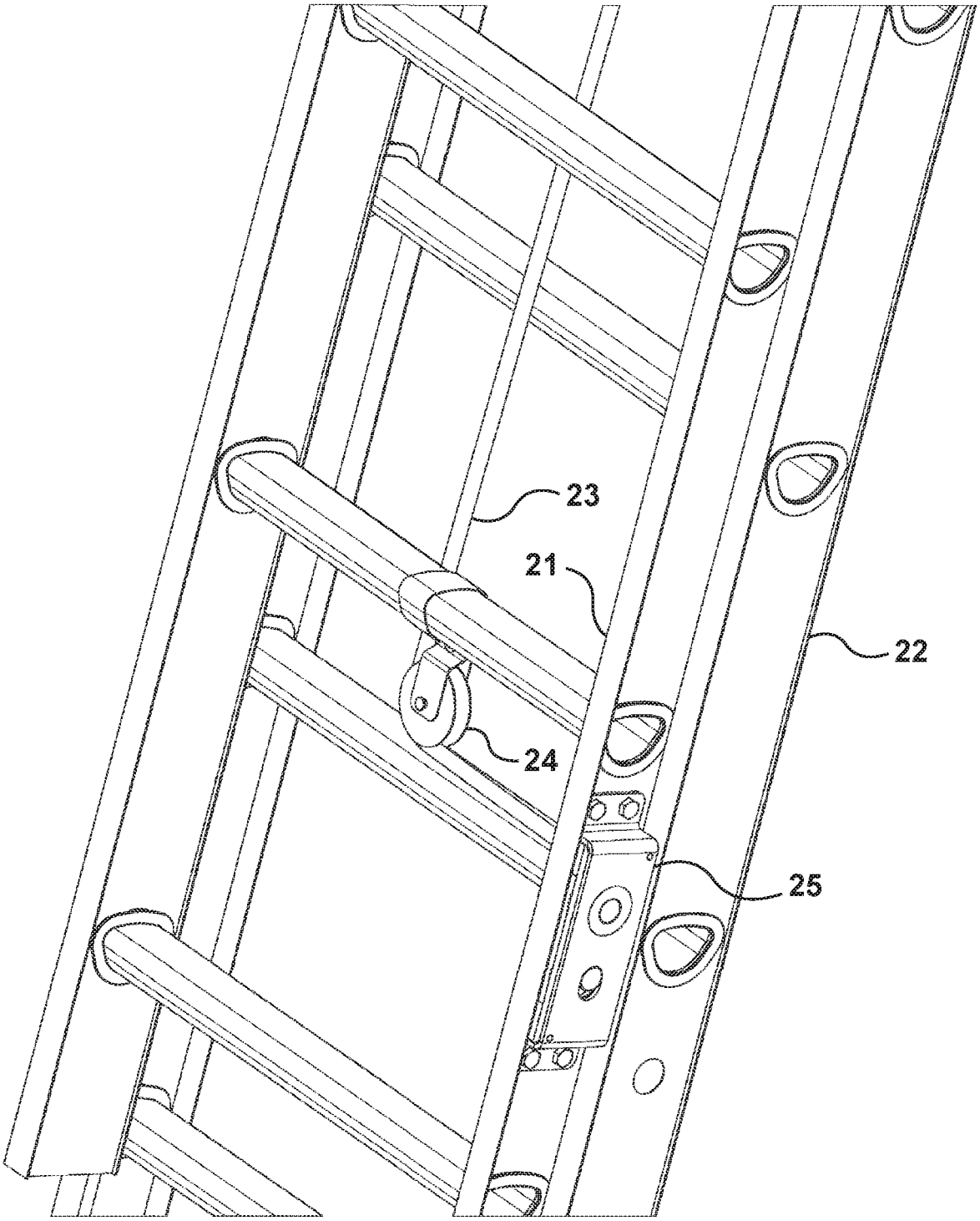
FIG. 1 is a perspective view of an exemplary braking system on an extendable ladder.

FIG. 1 illustrates a base ladder section 22, an extension or fly ladder section 21, an extension adjustment rope 23, a rope force direction changing component 24, such as a pulley, and a brake assembly 25. The brake assembly 25 is shown mounted on the fly section 21 although it will be appreciated that it may be mounted on the base section 22. Pulling on the loose hanging end of the rope releases the brake, and releasing the rope automatically activates the brake.

Figure 11:
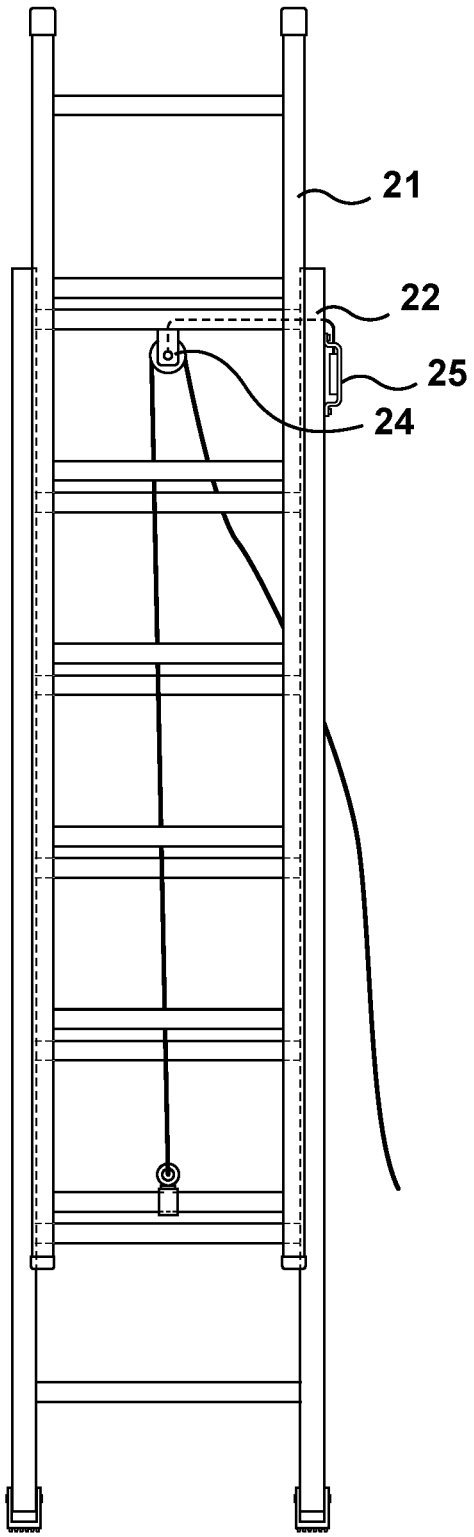
FIG. 11 is a front view of another exemplary braking system on an extendable ladder.

The rope force direction changing component 24 is shown mounted near a bottom of the fly section 21. If the brake assembly 25 is mounted on a top of the base section 22 as shown in FIG. 11, the rope force direction changing component 24 would be coupled to a pulley at the top of the base section 22. When the rope 23 is pulled, the pulley is pulled downward and the rope force direction changing component 24 retracts the brake retractor. The rope force direction changing component 24 may be a pulley as shown, or a tube that bends 90 degrees, or a lever, or any mechanism that releases the brake when force is applied to the rope.

When the brake is mounted at the bottom of the fly section 21, a small hole may be drilled in the top of the lowest rung on the fly section 21, large enough for a cable to pass through. The rope 23 can hook onto the cable above the rung hole. The cable can attach to a lever inside the rung that operates the brake retractor. Alternatively, there can be a slow 90 degree turn, made of an aluminum tube, inside the hollow part of the rung that travels all the way to the rail. The aluminum tube would be substantially L-shaped with a threaded portion at the end which allows the end of the L to attach with a small nut to the hole on the top of the ladder rung. Alternatively, to avoid drilling a hole in the rung, a metal or composite tube or sleeve may be provided that starts on the back side of the same rung and spirals around the rung from the top of the rung to the bottom of rung and from the center of the rung to one end of the rung to the side rail. The rope or cable can be inside this sleeve all the way to the brake assembly.

Figure 2:
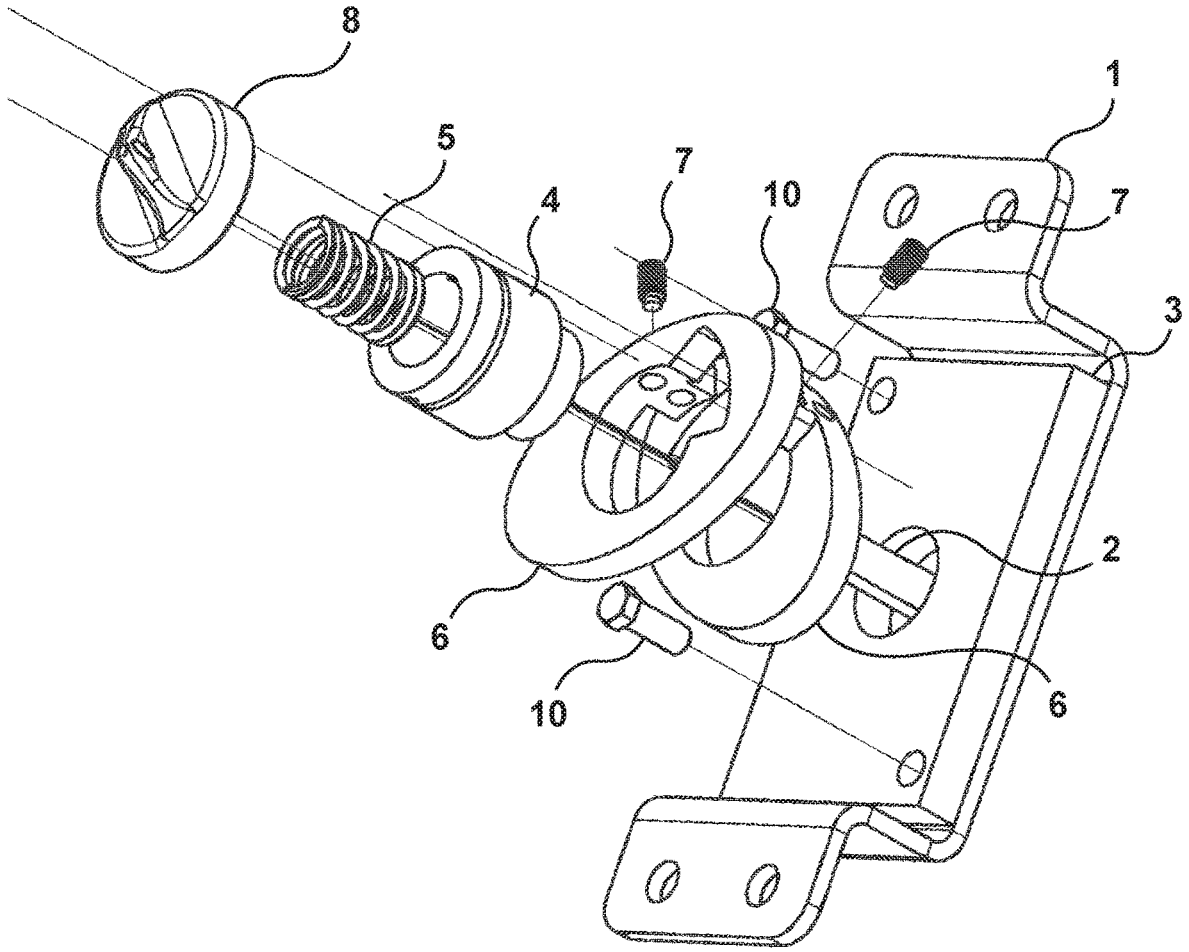
FIG. 2 is an exploded view of the components that make up the braking system of FIG. 1.

Turning now to FIG. 2, the brake assembly 25 is shown. The assembly uses a leading cam, in contrast to a trailing cam, which means that the cam is configured so that sliding motion to be opposed by the brake causes the brake to be more engaged rather than tending to release the brake. Such a cam is more engaged by sliding in only one direction. If sliding in both directions is to be opposed by the braking system, two leading cams are required, one for each direction. Alternatively, a single brake structure may be used which is neutral, neither leading nor trailing, or which, when pulled in either direction by sliding friction, wedges against one of two inclined planes affixed to the brake base, in which case a single brake structure can act as a "leading" wedge to stop motion in both directions.

FIG. 2 shows two cams 6. A spring 5 urges each cam into engagement with the rail of the base ladder section 22 until force is applied via the rope, or a cable coupled to the rope, to the brake retractor 8 which retracts the cams. Instead of using a single spring, a separate spring could be used for each cam. Instead of using a single brake retractor, a separate retractor could be used for each cam.

In the design of FIG. 2, force applied to either cam by the rail of a ladder section is passed to the brake base 1 which is mounted on the other section. The brake assembly shown in FIG. 2 can be mounted on either ladder section to apply braking against the rail of the other section. Each cam has two lobes. The lobes protrude beyond the edge of the base 1 to engage the rail of a ladder section. Because the lobes protrude beyond the edge of the base 1 on both sides of the base, the brake assembly can be mounted with either side against the rail of a ladder section. Also shown in FIG. 2, each cam 6 has a setscrew 7 that protrudes into a groove in an actuator 4 that is acted upon by the spring 5. Force is carried from the cams 6 to the actuator 4 to a plate 3 to bolts or rivets 10 to the base 1.

The system provides an automatic, secondary, back-up, braking system that instantly slows or stops a fly section ladder rail, regardless of its position relative to the base section, from moving downward or upward when the rope used to adjust the fly section up or down is released. The brake is retracted when a minimum of about ¼ pound of tension is applied to the rope that is used to adjust the fly section up or down.

Another embodiment of the application, in relation to accidental sliding of the fly section in the downward direction only, can be a small rope-cam-cleat device or jam-cleat, with a grooved, ribbed face or edge, located just above the rope inside the pulley wheel at the top of the base ladder section. The pulley shaft may be mounted with a spring such that the spring pulls the rope into the jam-cleat or cam-cleat when force on the rope is released. When force is applied to the rope, the spring compresses and the rope is pulled away from the jam-cleat or cam-cleat.

A spring in this pulley-plus-jam-cleat is not required because the rope has some elasticity. If the rope is accidentally released the rope jumps upward and slightly outward at the pulley wheel and can be grabbed by the ribbed surface of the jam-cleat, thereby jamming and stopping or slowing the rope. This does not keep the fly section from sliding upward but it is a very low cost way of adding an emergency brake for the downward direction. The cam grabs the rope as it jumps upward when the rope is accidentally released.

The most common extension ladder has the rope connected to (looped around) the bottom rung of the fly section. This is why the brake will almost always be attached to the rail of the fly section. There are some ladders that have a rope and double pulley system attached to the right side of the ladder to keep the rope out of the way. The brake assembly can connect to either the top pulley, attached to the base section, or the bottom pulley, attached to the fly section.

Figure 3:
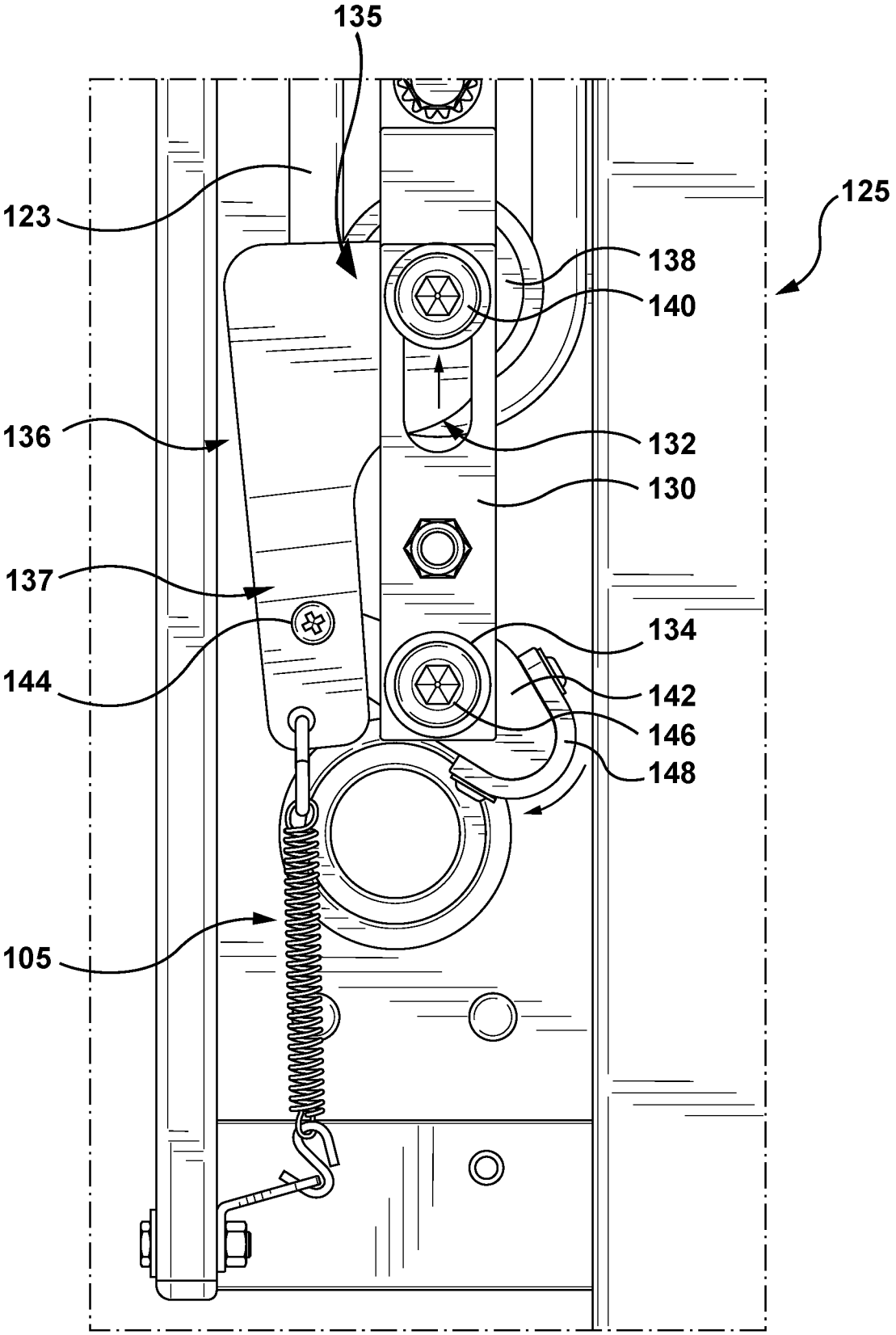
FIG. 3 is a view of another exemplary braking system in a disengaged position on an extendable ladder.
Figure 4:
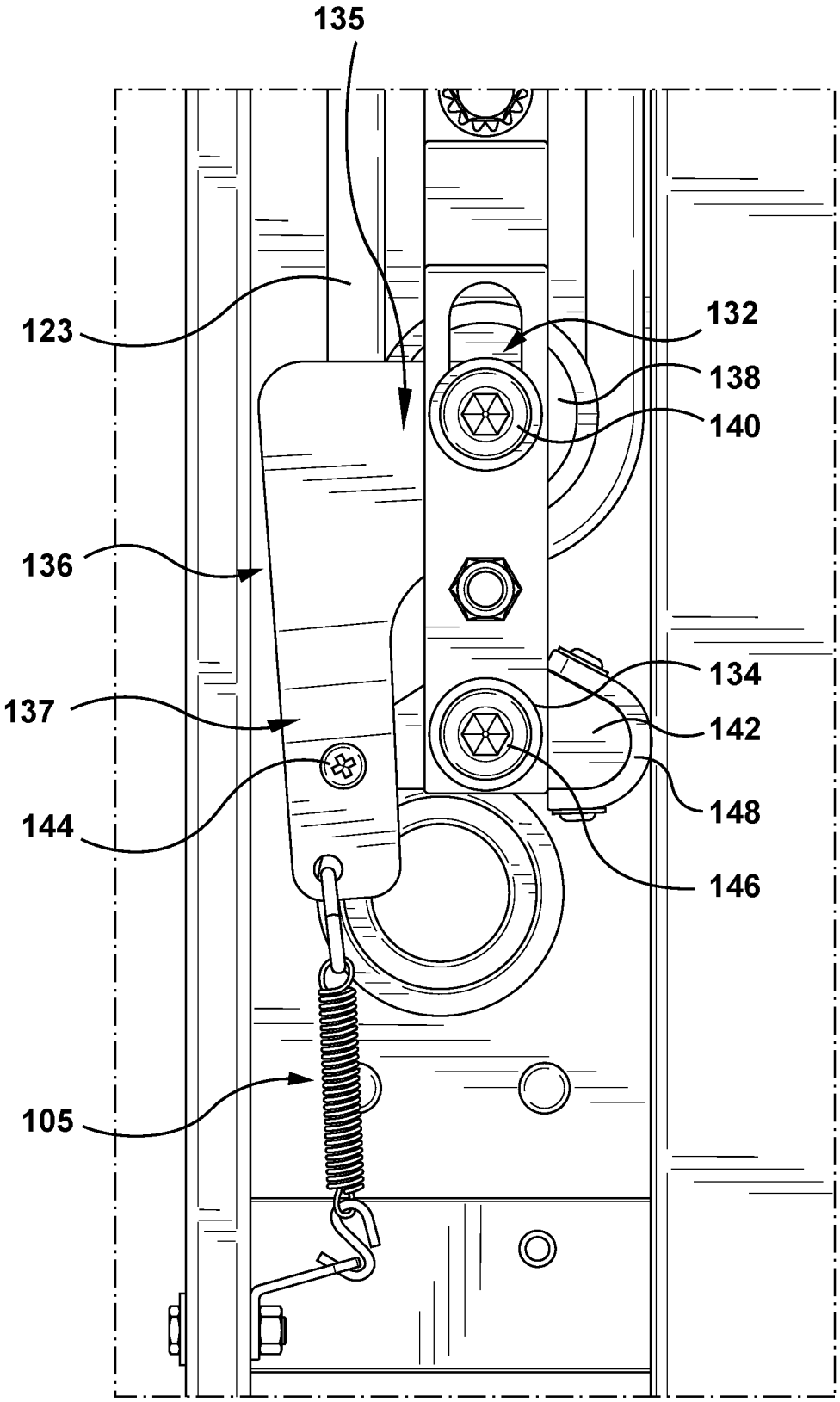
FIG. 4 is a view of the braking system of FIG. 3 in an engaged position on an extendable ladder.
Figure 5:
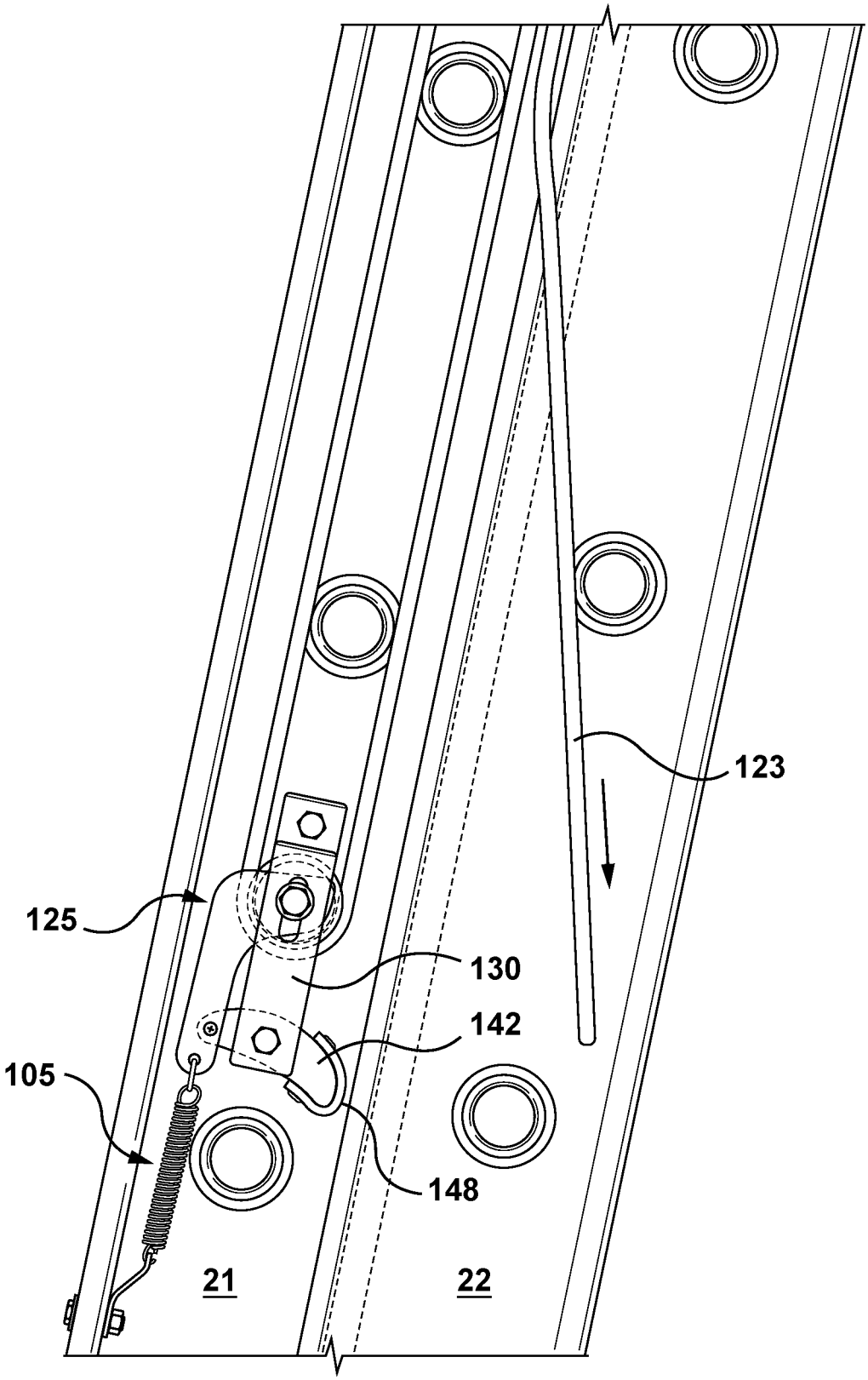
FIG. 5 is another view of the braking system of FIG. 3 on an extendable ladder.

Turning now to FIGS. 3-5, another exemplary embodiment of a brake assembly is shown at 125. The brake assembly 125 is substantially the same as the above-referenced brake assembly 25, and consequently the same reference numerals but indexed by 100 are used to denote structures corresponding to similar structures in the brake assemblies. In addition, the foregoing description of the brake assembly 25 is equally applicable to the brake assembly 125 except as noted below.

The brake assembly 125 includes a bracket 130 that is attached to the fly section 21. Specifically, the brake assembly 125 can be mounted on the side rail of the fly section 21 facing either inwards or outwards. The bracket 130 is mounted vertically to the fly section 21, substantially parallel with the vertical rails of the ladder. The bracket 130 includes a slot 132 and a through-hole 134 spaced a distance from each other vertically along the length of the bracket 130. The brake assembly 125 further includes an arm 136 and a pulley 138. The arm 136 is generally L-shaped, having a horizontally extending portion and a vertically extending portion. The pulley 138 and the horizontally extending portion of the arm 136 are connected by a first pin 140 that extends through each of a center of the pulley 138, a hole in the horizontally extending portion of the arm 136, and the slot 132 in the bracket 130. The first pin 140 extends through the slot 132 such that the arm 136 is movable with the pulley 138 along the length of the slot 132, relative to the bracket 130. A cam 142 is pivotally attached at a first end to the vertically extending portion of the arm 136 by a second pin 144, and is pivotally attached to the bracket 130 by a third pin 146. It should be appreciated that the first pin 140, second pin 144, and the third pin 146 can also be any attaching means such as a bolt, screw, or rivet.

The cam 142 can be any shape capable of being rotated in and out of an engaged position, including, but not limited to oblong, oval, rounded with a knob, angled link, etc. The cam 142 has a tread 148 around the end of the cam 142 opposite the connection to the arm 136. The tread 148 is designed to provide friction between the cam 142 and an adjacent rail or surface of the ladder. The tread 148 can be made of rubber, or any other material with a sufficiently high coefficient of friction. The brake assembly 125 also includes a resilient member 105 attached at one end to the bottom end of the vertically extending portion of the arm 136 and attached at its other end to the fly section 21 of the ladder. The resilient member 105 can be attached directly to the fly section 21 or can attach to a bracket, loop, or other connection means attached to the fly section 21. The resilient member 105 biases the arm 136 in a downward direction. The resilient member 105 can be, for example, a spring or elastic material, among others.

As shown in FIG. 3, a rope 123 interacts with the pulley 138 such that when tension is applied to the rope 123, the pulley 138 is lifted upwards along with the arm 136 and the first pin 140. As the rope's 123 tension pulls the pulley 138 upwards, the first pin 140 slides upwards in the slot 132 until the first pin 140 makes contact with the top end of the slot 132. The upward movement of the arm 136 causes the cam 142 to pivot around the third pin 146 and retract inwards to a disengaged position, away from the rail of the ladder.

Turning now to FIG. 4, when tension is released from the rope 123, the resilient member 105 pulls the arm 136 downwards along with the pulley 138 and the first pin 140. As the resilient member 105 pulls downwards, the first pin 140 slides downwards in the slot 132 until the first pin 140 makes contact with the bottom end of the slot 132. The downward motion of the arm 136 causes the cam 142 to pivot around the third pin 146 and extend outwards to an engaged position, towards the rail of the ladder. In this engaged position, the tread 148 on the cam 142 comes into frictional engagement with a rail or other surface of the base section 22.

In an embodiment, the brake assembly 125 is attached to the fly section 21 of a ladder. When a user wants to raise the fly section 21 with respect to the base section 22 of the ladder, the user pulls on a rope 123. The rope 123 interacts with the pulley 138 such that when the user applies tension to the rope 123, the pulley 138 is lifted upwards along with the arm 136, causing the cam 142 to disengage with a rail or other surface of the base section 22 of the ladder. When the brake assembly 125 is in this disengaged position shown in FIG. 3, further tension on the rope 123 applied by a user causes the upward force on the pulley 138 and the first pin 140 to transfer to the bracket 130, lifting the entire fly section 21 with respect to the base section 22.

If the user suddenly releases grip of the rope 123 or the rope 123 slips out of the user's hand, the rope's 123 tension is released, allowing the resilient member 105 to pull the arm 136 downward along with the pulley 138 and the first pin 140. The downward motion of the arm 136 causes the cam 142 to frictionally engage with the rail or other surface of the base section 22. When the brake assembly 125 is in this engaged position shown in FIG. 4, the friction between the tread 148 of the cam 142 and the rail or other surface of the base section 22 prevents the fly section 21 from falling downward with respect to the base section 22.

Figure 6:
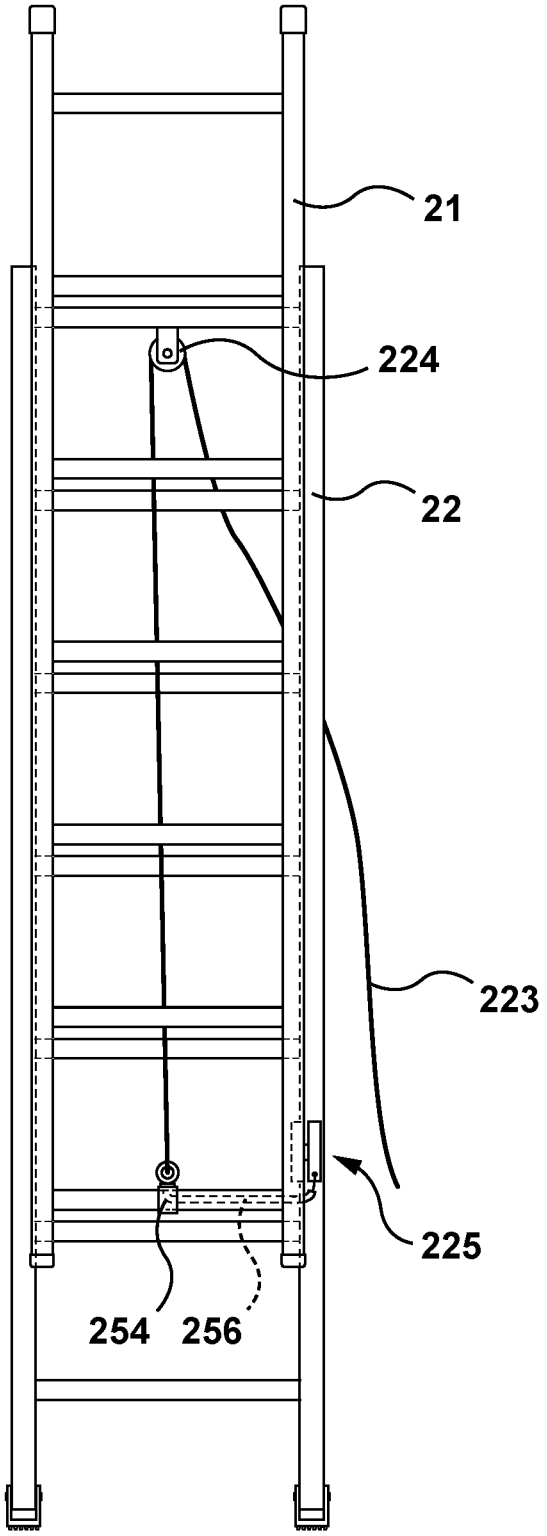
FIG. 6 is a front view of another exemplary braking system on an extendable ladder.
Figure 7:
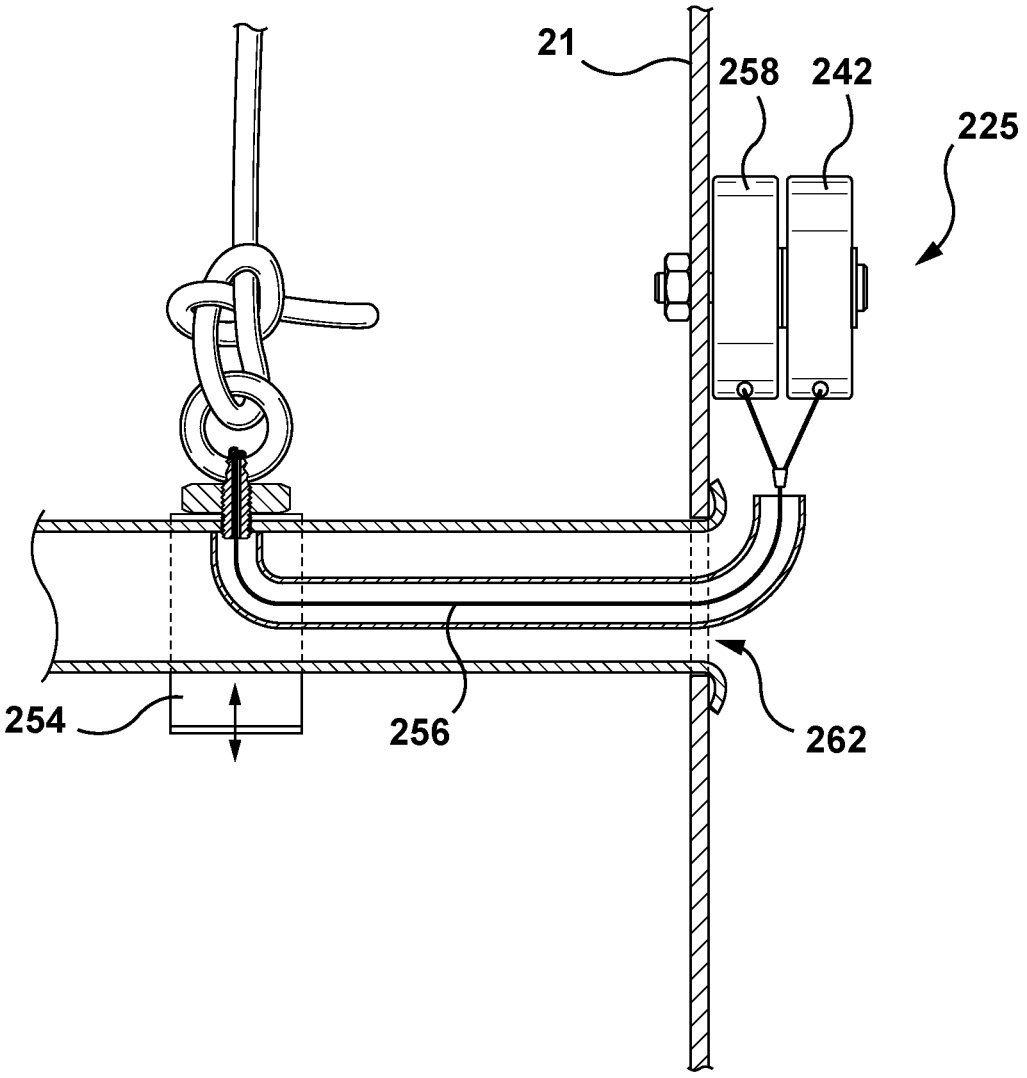
FIG. 7 is an enlarged front view of the braking system of FIG. 6 on an extendable ladder.
Figure 8:
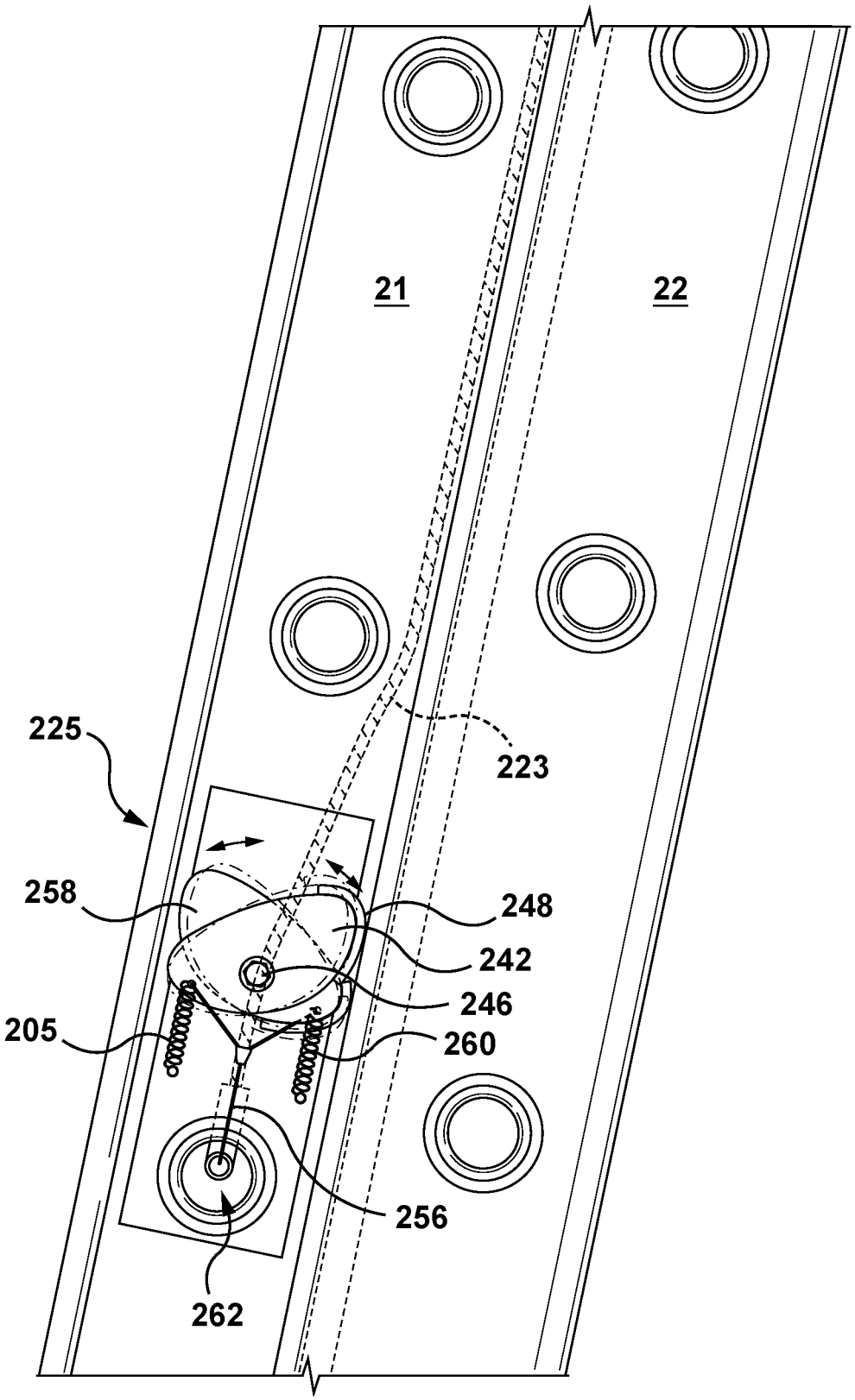
FIG. 8 is a side view of an exemplary braking system on an extendable ladder.

Turning now to FIGS. 6-8, another exemplary embodiment of a brake assembly is shown at 225. The brake assembly 225 is substantially the same as the above-referenced brake assembly 125, and consequently the same reference numerals but indexed by 100 are used to denote structures corresponding to similar structures in the brake assemblies. In addition, the foregoing description of the brake assembly 125 is equally applicable to the brake assembly 225 except as noted below.

In certain embodiments, the rope 223 has a free end, and is routed around an upper pulley 224 that is attached to the base section 22 of the ladder either on a rung or a rail. The rope 223 continues downwards and is attached at an end to a lifting member 254. The lifting member 254 can be constructed out of any material strong enough to lift the weight of the fly section 21 of the ladder. The material can be a metal such as aluminum or steel, or a strong plastic, among others. The rope 223 can be attached to the top of the lifting member 254 by any means including, but not limited to a knot through a ring connected to the lifting member 254. The lifting member 254 is linked to a rung of the fly section 21 such that the lifting member 254 is fixed in a horizontal position on the rung, but is able to be moved vertically over a limited distance. The vertical distance that the lifting member 254 can move is limited in a first direction by contact between the bottom of the lifting member 254 and the bottom of the rung of the fly section 21 and in a second direction by contact between the top of the lifting member 254 and the top of the rung of the fly section 21. The rung of the fly section 21 can be hollow to receive and guide a cable 256 passing through the interior of the rung. This hollow rung can be made out of any material capable of supporting normal ladder weight requirements, including, but not limited to aluminum or steel. The cable 256 connects at a first end to the lifting member 254 and at a second end to the brake assembly 225.

As shown in FIG. 8, the brake assembly 225 includes at least one cam 242 pivotably connected to the side rail of the fly section 21 by a pin 246 extending through the cam 242 into the side rail. One end of the cam 242 is connected to a resilient member 205 that biases the cam 242 such that the tread 248 rotates outwards to engage the rail or surface of the base section 22 of the ladder. In certain embodiments, the resilient member 205 can be a torsion spring that interacts with the pin 246 to rotatably bias the cam 242. The end of the cable 256 is routed through the hollow portion of the rung of the fly section 21, out of an aperture 262 defined by the end of the hollow rung at a location below the cam 242, and into the brake assembly 225. Within the brake assembly 225, the cable 256 connects to the end of the cam 242 that is also connected to the resilient member 205. It should be appreciated that the brake assembly 225 can include a second cam 258 and a second resilient member 260. In this case, the second cam 258 can be connected to the side rail of the fly section 21 by the same pin 246 that connects the first cam 242. The cable 256 splits into two cable ends, each cable end attaching to one of the cams 242, 258. One of the cams 242 or 258 can frictionally engage with the base section 22 to restrict movement in an upward direction while the other cam 242 or 258 can frictionally engage with the base section 22 to restrict movement in a downward position. Each cam 242, 258 includes a stopping mechanism such as a mounted pin or a detent that contacts a groove or other surface mounted on or built into the fly section 21 or brake mechanism 225 to prevent the cams 242, 258 from continuing to rotate when in the engaged position. In some embodiments, the stopping mechanism is located on the fly section 21 or brake mechanism 225.

In an embodiment, the brake assembly 225 is attached to the fly section 21 of a ladder. When a user wants to raise the fly section 21 with respect to the base section 22 of the ladder, the user pulls on the rope 223. The rope 223, by way of the upper pulley 224, provides an upward force on the lifting member 254. The upward force creates tension on the cable 256. The cable 256 tension pulls downwards on the end of the cam 242, opposing the force of the resilient member 205. The downward force of the cable 256 causes the cam 242 to rotate and retract inwards into a disengaged position. When the brake assembly 225 is in this disengaged position, further tension on the rope 223 applied by a user lifts the lifting member 254 until the bottom of the lifting member 254 contacts the bottom of the rung of the fly section 21. Further upward force from the lifting member 254 raises the entire fly section 21 with respect to the base section 22.

If the user suddenly releases grip of the rope 223, or the rope 223 slips out of the user's hand, the rope's 223 tension is released. When the rope's 223 tension is released, the lifting member 254 drops so that the top of the lifting member contacts the top of the rung of the fly section 21. This action provides slack to the cable 256, allowing the resilient member 205 to rotate the cam 242 such that the cam 242 comes into frictional engagement with a rail or surface of the base section 22. When the brake assembly 225 is in this engaged position, the friction between the tread 248 of the cam 242 and the rail or other surface of the base section 22 prevents the fly section 21 from falling downward with respect to the base section 22. In embodiments of the brake assembly 225 having two cams 242 and 258, each cam can have oppositely directed leading orientations such that the cams 242 and 258 work in tandem to restrict the fly section 21 from moving in both the downwards and upwards direction with respect to the base section 22.

Figure 9:
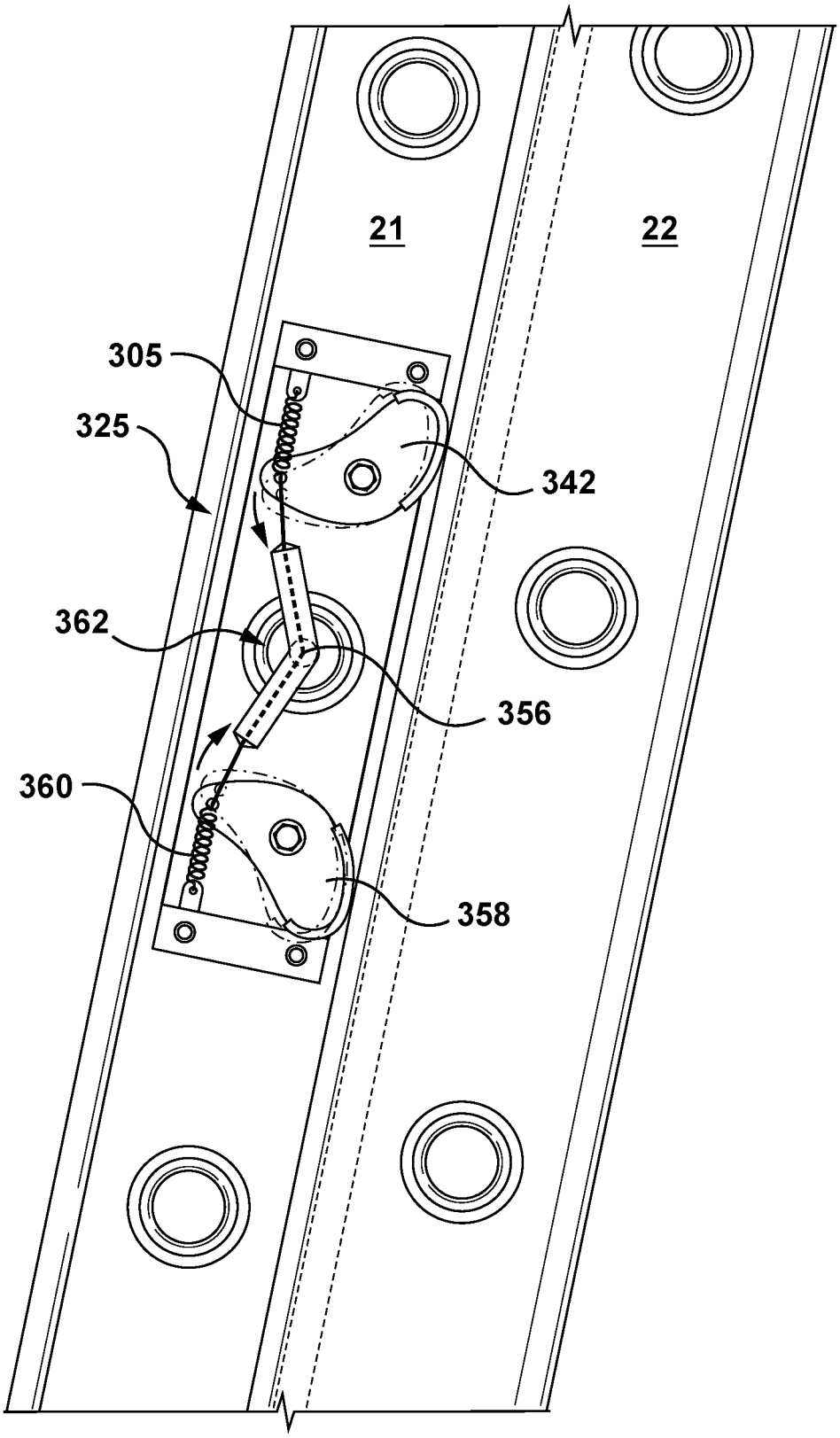
FIG. 9 is a side view of an exemplary braking system on an extendable ladder.

Turning now to FIG. 9, another exemplary embodiment of a brake assembly is shown at 325. The brake assembly 325 is substantially the same as the above-referenced brake assembly 225, and consequently the same reference numerals but indexed by 100 are used to denote structures corresponding to similar structures in the brake assemblies. In addition, the foregoing description of the brake assembly 225 is equally applicable to the brake assembly 325 except as noted below.

The brake assembly 325 can include a first cam 342 and a second cam 358. The cable 356 enters the brake assembly 325 through the hollow rung's aperture 362 located vertically between the first cam 342 and the second cam 358. The cable 356 splits into two cable ends, with one cable end routed upwards to connect to the first cam 342 and the other cable end routed downwards to connect to the second cam 358. A first resilient member 305 is connected to the fly section 21 on one end and connected to a first end of the first cam 342 in such a way that biases the first cam 342 outwards so that the first cam 342 is frictionally engaged with the rail or surface of the base section 22. Similarly, a second resilient member 360 is connected to the fly section 21 on one end and connected to a first end of the second cam 358 in such a way that biases the second cam 358 outwards so that the second cam 358 is frictionally engaged with the rail or surface of the base section 22. Each cam can have oppositely directed leading orientations such that the cams 342 and 358 work in tandem to restrict the fly section 21 from moving in both the downwards and upwards direction with respect to the base section 22.

Figure 10:
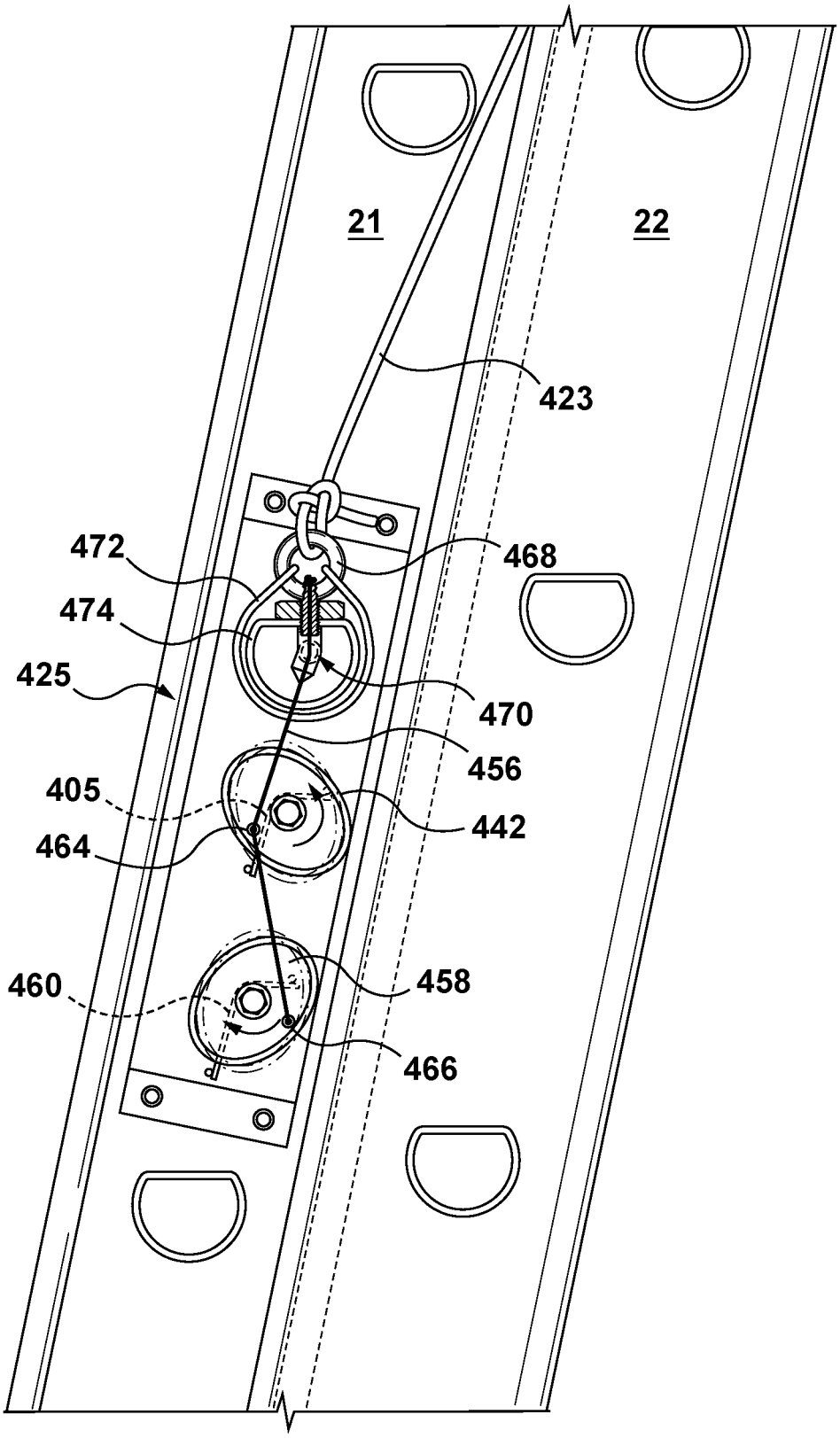
FIG. 10 is a side view of an exemplary braking system on an extendable ladder.

Turning now to FIG. 10, another exemplary embodiment of a brake assembly is shown at 425. The brake assembly 425 is substantially the same as the above-referenced brake assembly 225, and consequently the same reference numerals but indexed by 200 are used to denote structures corresponding to similar structures in the brake assemblies. In addition, the foregoing description of the brake assembly 225 is equally applicable to the brake assembly 425 except as noted below.

The brake assembly 425 includes a first cam 442 having a first connection point 464 and a second cam 458 having a second connection point 466. The first cam 442 and second cam 458 are rotatably attached to, and arranged vertically on the fly section 21. The first cam 442 and second cam 458 are biased by a first torsion spring 405 and a second torsion spring 460, respectively. The respective torsion springs 405 and 460 bias the cams such that the cams frictionally engage with the rail or surface of the base section 22. A cable 456 is attached at a first end to a ring 468 or other attachment point. The cable 456 is routed downwards through a cable guide 470. The cable 456 then connects to the first connection point 464 on the first cam 442. From the first connection point 464, the cable 456 is routed further downwards, and the second end of the cable 456 is attached to the second connection point 466 on the second cam 458.

The ring 468 is attached to a larger loop 472. The loop 472 can be a strap, a wire, a cable, etc. The loop 472 encircles an anchor point 474 with enough slack to allow for limited vertical movement of the loop 472 with respect to the anchor point 474. The anchor point 474 is ridgedly attached to the brake assembly 425 or the fly section 21. An end of a rope 423 is tied or attached to the ring 468.

In an embodiment, the brake assembly 425 is attached to the fly section 21 of a ladder. When a user wants to raise the fly section 21 with respect to the base section 22 of the ladder, the user pulls on the rope 423. The rope 423 interacts with a pulley on the base section 22 such that when the user applies tension to the rope 423, the ring 468 is lifted upwards along with the loop 472 until the bottom of the loop 472 contacts the anchor point 474. The upward lift of the ring 468 creates upward tension in the cable 456. This tension in the cable 456 rotates the first cam 442 and the second cam 458 by pulling upwards on the respective connection points 464 and 466) The first cam 442 and second cam 458 rotate inwards such that the cams disengage from the rail or surface of the base section 22. When the brake assembly 425 is in this disengaged position, further tension on the rope 423 applied by a user causes the upward force on the anchor point 474 to lift the entire fly section 21 with respect to the base section 22.

If the user suddenly releases grip of the rope 423, or the rope 423 slips out of the user's hand, the rope's 423 tension is released, allowing the torsion springs 405 and 460 to rotate the first cam 442 and second cam 458 outwards such that the cams frictionally engage the rail or surface of the base section 22. When the brake assembly 425 is in this engaged position, the friction between the treads 448 of the cams 442 and 458 and the rail or other surface of the base section 22 prevents the fly section 21 from falling downward with respect to the base section 22. Each cam can have oppositely directed leading orientations such that the cams 442 and 458 work in tandem to restrict the fly section 21 from moving in both the downwards and upwards direction with respect to the base section 22.

In addition, although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A braking system for use with an extension ladder having a base section and a fly section movable relative to the base section via an adjustment rope, the braking system including:

a bracket for attachment to the fly section;

a pulley movable relative to the bracket by the adjustment rope;

an arm movable with the pulley, wherein the arm and the pulley are movable between a first position when no tension is applied to the adjustment rope and a second position when tension is applied to the adjustment rope;

a cam attached to the arm and movable between:

an engaged position when the pulley and arm are in the first position with the cam frictionally engaging with a rail of the base section, wherein solely the frictional engagement of the cam with the rail of the base section prevents movement of the fly section relative to the base section, and a disengaged position when the pulley and arm are in the second position with the cam disengaged from the rail of the base section to allow movement of the fly section relative to the base section; and a resilient member attached to the arm and attachable to the fly section, the resilient member configured to bias the arm and the pulley in the first position and to move the arm and the pulley from the second position to the first position when no tension is applied to the adjustment rope.

2. The braking system of claim 1, wherein the bracket includes a slot.

3. The braking system of claim 1, wherein the arm comprises a vertical portion and a horizontal portion, and wherein the cam and the resilient member are attached to the vertical portion.

4. The braking system of claim 3, wherein the cam is pivotally attached to the vertical portion of the arm by a pin.

5. The braking system of claim 4, wherein the cam is pivotally attached to the bracket by a pin.

6. The braking system of claim 1, wherein the resilient member is a spring.

7. The braking system of claim 1, wherein the cam includes a tread that engages with the base section in the engaged position.

8. The braking system of claim 7, wherein the tread is rubber.

9. A braking system for an extension ladder having a base section and a fly section, the braking system comprising:

a bracket for attachment to the fly section of the extension ladder, the bracket having a slot;

a pulley that interacts with a rope;

an arm comprising a horizontal portion and a vertical portion; and a cam pivotally attached at a first point to the vertical portion of the arm and at a second point to the bracket, wherein the cam is movable between an engaged position with the cam frictionally engaging any area along a length of a front surface of a rail of the base section to slow or prevent movement of the fly section relative to the base section, and a disengaged position with the cam disengaged from the rail of the base section to allow movement of the fly section relative to the base section.

10. The braking system of claim 9, further comprising a resilient member attached to the vertical portion of the arm and attachable to the fly section, the resilient member configured to bias the arm in a first position and to move the arm from a second position to the first position when no tension is applied to the rope.

11. The braking system of claim 10, wherein the resilient member is a spring.

12. The braking system of claim 9, wherein the cam includes a tread, and wherein the tread engages with the base section in the engaged position.

13. The braking system of claim 12, wherein the tread is rubber.

14. The braking system of claim 9, wherein the cam is pivotally attached to the vertical portion of the arm by a pin.

15. The braking system of claim 9, wherein the cam is pivotally attached to the bracket by a pin.

16. The braking system of claim 15, wherein the pin attaches the cam to the bracket at a location beneath the slot.

17. A braking system for an extension ladder having a base section and a fly section, the braking system comprising:

a rope; and a brake assembly having a disengaged position that allows upwards or downwards movement of the fly section relative to the base section when a tension is applied to the rope and an engaged position that slows or resists upwards or downwards movement of the fly section relative to the base section regardless of the fly section's position relative to the base section, upon removal of the tension from the rope, wherein the brake assembly is configured to slow or resist movement of the fly section solely by frictionally engaging a rail of the base section at any point along a front surface of the rail.

18. The braking system of claim 17, wherein the brake assembly is configured to be mounted to the fly section.

* * * * *